United States Patent [19]

Patz

[11] Patent Number: 4,558,943

[45] Date of Patent: Dec. 17, 1985

[54] DEVELOPER ROLLER

[75] Inventor: Herbert S. Patz, Wayland, Mass.

[73] Assignee: Xerox Corporation, Stamford, Conn.

[21] Appl. No.: 549,094

[22] Filed: Nov. 7, 1983

[51] Int. Cl.[4] ..... G03G 15/08; G03G 15/09

[52] U.S. Cl. ..... 355/3 DD; 118/658

[58] Field of Search ..... 355/3 R, 3 DD; 118/656, 118/657, 658, 661

[56] References Cited

U.S. PATENT DOCUMENTS

| | | | |
|---|---|---|---|
| 3,863,603 | 2/1975 | Buckley et al. | 118/658 |
| 3,945,342 | 3/1976 | Drummond | 118/658 |
| 4,194,830 | 3/1980 | Ohnuma et al. | 355/3 DD |
| 4,425,382 | 1/1984 | Tajima | 118/657 X |

*Primary Examiner*—Fred L. Braun

*Attorney, Agent, or Firm*—H. Fleischer; J. E. Beck; R. Zibelli

[57] ABSTRACT

An apparatus in which a latent image recorded on an image receiving member is developed. A developer roller transports the marking particles into the development zone. The developer roller has the exterior surface thereof roughened forming a multiplicity of peaks extending outwardly therefrom with a coating of polymeric material filling the space between adjacent peaks. A blade is positioned to have the free end thereof contacting the peaks on the developer roller. The blade has a plurality of apertures therein through which the marking particles pass. In this way, the thickness of the layer of marking particles on the developer roller is controlled.

26 Claims, 3 Drawing Figures

DEVELOPER ROLLER

This invention relates generally to an electrophotographic printing machine, and more particularly concerns an apparatus for developing a latent image recorded on a photoconductive surface.

Generally, the process of electrophotographic printing includes charging a photoconductive surface to a substantially uniform potential. The charged portion of the photoconductive surface is exposed to a light image of an original document being reproduced. This records an electrostatic latent image on the photoconductive surface corresponding to the informational areas contained within the original document. After the electrostatic latent image is recorded on the photoconductive surface, the latent image is developed by bringing a developer material into contact therewith. This forms a toner powder image on the photoconductive surface. Subsequently, the toner powder image is transferred to a copy sheet. Finally, the powder image is heated to permanently affix it to the copy sheet in image configuration.

In the foregoing type of printing machine, a development system is employed to deposit developer material onto the photoconductive surface. Generally, the developer material comprises toner particles, which are mixed with coarser carrier granules. Typically, the toner particles are made from a thermoplastic material with the carrier granules being made from a ferro-magnetic material. Alternatively, single component magnetic particles may be employed. A system utilizing single component magnetic developer material may be capable of high speeds. One type of development apparatus employing a single component magnetic material is described in U.S. Pat. No. 2,846,333 issued to Wilson in 1958. It has been found that when employing a single component developer material, it is highly desirable to meter a uniform layer of toner particles onto the developer material. Preferably, this layer of developer material is of a thin, controlled thickness. Uniform metering of a thin layer of toner particles, hereinbefore, placed stringent requirements on the mechanical design tolerances of the parts in the development system. In particular, it has been necessary to provide a uniform gap between the metering blade and the developer roller. This gap is of a very small width and the out of round condition of the developer roller relative to the positioning of the metering blade frequently introduced variations in the thickness of the layer of particles deposited thereon. Moreover, metering of a thin layer of particles onto the developer roller produced variations in the layer of thickness due to the non-uniformity in the toner particles.

The developer roller may have a coating thereon which interacts with the toner particles moving thereover. This interaction triboelectrically charges the toner particles. However, inasmuch as the coating on the developer roller is made from a relatively soft material, a metering blade for regulating the quantity of toner particles being advanced over the developer roller must be spaced therefrom. If the metering blade contacts this coating, the coating will rapidly wear resulting in a shortening of the life of the printing machine. It has been found that in order to precisely control the quantity of toner particles adhering to the developer roller, it is desirable to have the metering blade contact the developer roller. However, the metering blade rapidly wears away the soft polymeric coating on the developer roller significantly reducing the life of the development system in the printing machine. Thus, the development system must satisfy apparently contradictory requirements. The following disclosures relating to various types of developer rollers used in development systems appear to be relevant: U.S. Pat. No. 4,034,709; patentee: Fraser et al.; issued: July 12, 1977; U.S. Pat. No. 4,377,332; patentee: Tamura; issued: Mar. 22, 1983; U.S. Pat. No. 4,380,966; patentee: Isaka et al.; Issued: Apr. 26, 1983.

The relevant portions of the foregoing disclosures may be briefly summarized as follows:

Fraser et al. discloses a developer roller having a tubular member with a styrene-butadiene layer coated thereon. In addition, this patent also describes various techniques for roughing the exterior circumferential surface of the tubular member thereof that hereinbefore have been employed.

Tamura describes a developer roller employing a non-magnetic sleeve having concavo-convexities parallel to the axial direction.

Isaka et al. discloses a developer roller employing a sleeve having the exterior circumferential surface thereof roughened by a sand blasting treatment with irregular abrasive particles. FIG. 1 shows an elastomeric blade in contact with the sleeve.

In accordance with one aspect of the present invention, there is provided an apparatus for developing a latent image recorded on an image receiving member. The apparatus includes a housing defining a chamber for storing a supply of marking particles therein. Means transport the marking particles from the chamber in the housing to a development zone closely adjacent to the latent image recorded on the image receiving member. The transporting means comprises a support member having the exterior surface thereof roughened forming a multiplicity of peaks extending outwardly therefrom. A coating of a polymeric material fills the spaces between adjacent peaks so that at least the peaks of the support member extend beyond the coating of the polymeric material. Means are provided for controlling the thickness of the layer of marking particles on the transporting means. The controlling means has a free edge thereof contacting the peaks of the support member and being spaced from the polymeric coating thereon.

Pursuant to another aspect of the present invention, there is provided an electrophotographic printing machine of the type having a photoconductive member arranged to have the latent image recorded thereon. The printing machine includes a housing defining a chamber for storing the supply of marking particles therein. Means transport the marking particles from the chamber in the housing to a development zone closely adjacent to the latent image recorded on the photoconductive member. The transporting means comprises a support member having the exterior surface thereof roughened forming a multiplicity of peaks extending outwardly therefrom. A coating of polymeric material fills the spaces between adjacent peaks so that at least the peaks of the support material extend beyond the coating of polymeric material thereon. Means are provided for controlling the thickness of the layer of marking particles on the transporting means. The controlling means has a free edge contacting the peaks of the support member of the transporting means with the free edge being spaced from the polymeric material coated thereon.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
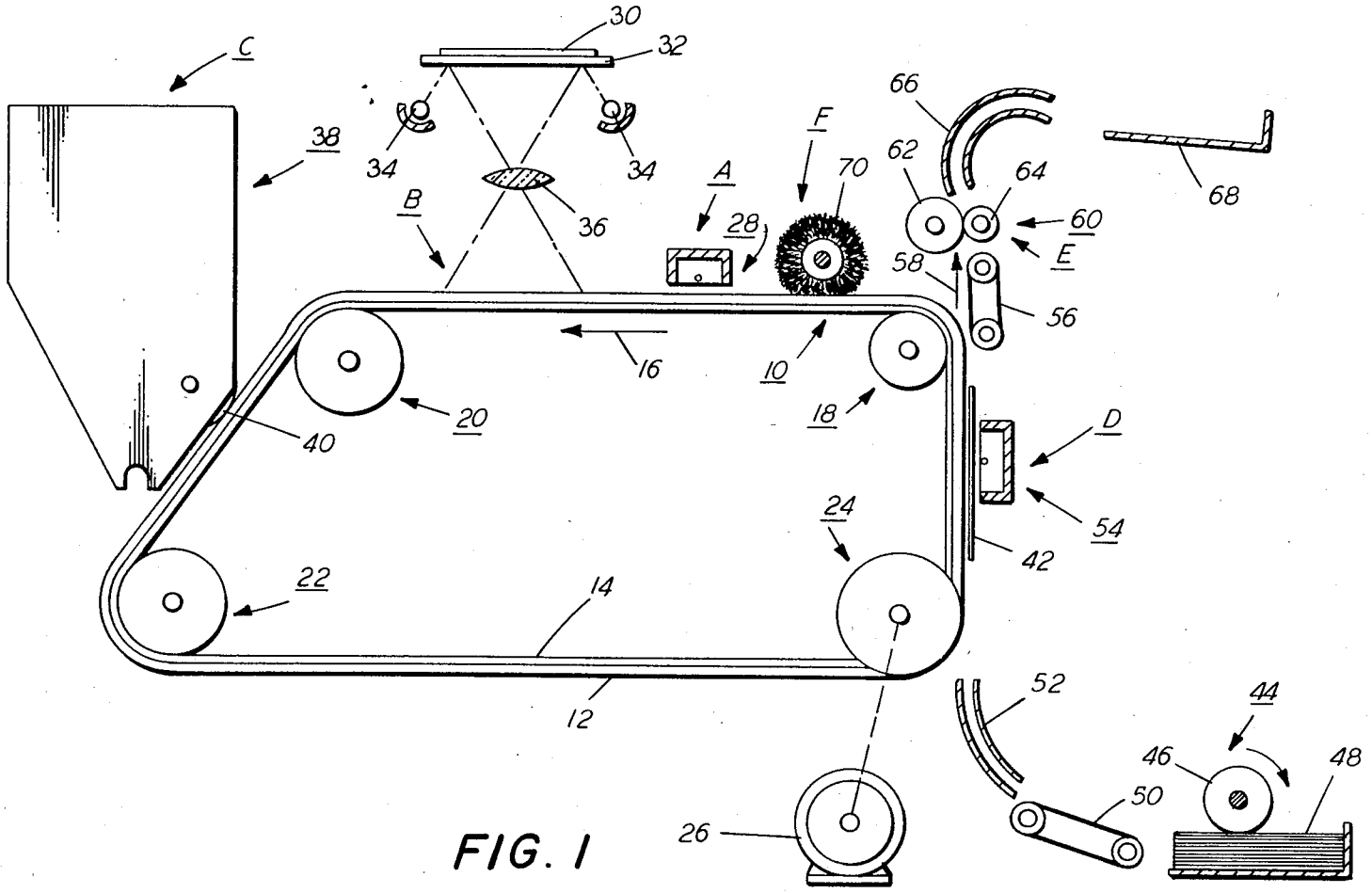
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development apparatus of the present invention therein. It will become evident from the following discussion that this apparatus is equally well suited for use in a wide variety of electrostatographic printing machines and is not necessarily limited in its application to the particular embodiment depicted herein.

In the illustrative electrophotographic printing machine, as shown in FIG. 1, a belt 10 having a photoconductive surface 12 deposited on a conductive surface 14, moves in the direction of arrow 16. Preferably, the conductive substrate comprises a transparent support such as a poly(ethyleneterpothiolate)cellulose acetate or other suitable photographic film supports, typically having coated thereon a transparent conductive coating such as high vacuum evaporated nickel, cuperous iodide or any suitable conducting polymer. The conductive support is, in turn, overcoated with a photoconductive layer typically comprising a binder and an organic photoconductor. A wide variety of organic photoconductors may be employed. For example, an organic amine photoconductor or a polyarylalkylene photoconductor may be used. However, one skilled in the art will appreciate that any suitable organic photoconductor compatible with the transparent conductive substrate may be utilized in the present invention. Various types of photoconductors are described in U.S. Pat. No. 3,734,724 issued to York in 1973, the relevant portions thereof being hereby incorporated into the present application. In the exemplary electrophotographic printing machine, the photoconductive layer has an electrostatic charge of a negative polarity recorded thereon with the charge on the marking particles being of a positive polarity.

With continued reference to FIG. 1, belt 10 moves in the direction of arrow 16 to advance successive portions of photoconductive surface 12 through the various processing stations disposed about the path of movement thereof. As shown, belt 10 is entrained about stripping roller 18, tension roller 20, idler roller 22 and drive roller 24. Drive roller 24 is mounted rotatably and in engagement with belt 10. Motor 26 rotates roller 24 to advance belt 10 in the direction of arrow 16. Roller 24 is coupled to motor 26 by suitable means such as a drive belt. Drive roller 24 includes a pair of opposed spaced edge guides. The edge guide defines a space therebetween which determines the desired path of movement of belt 10. Belt 10 is maintained in tension by a pair of springs (not shown) resiliently urging tension roller 20 against belt 10 with the desired spring force. Stripping roller 18, tension roller 20 and idler roller 22 are mounted rotatably. These rollers are all idler rollers and rotate freely as belt 10 moves in the direction of arrow 16.

Initially, a portion of belt 10 passes through charging station A. At charging station A, a corona generating device, indicated generally by the reference numeral 28, charges photoconductive surface 12 of belt 10 to a relatively high, substantially uniform potential having a negative polarity. One skilled in the art will appreciate that the polarity of the charge imposed upon the photoconductive surface depends upon the selected photoconductor material and a suitable photoconductor material may be utilized wherein a positive polarity is applied rather than a negative polarity.

Next, the charged portion of photoconductive surface 12 advances through exposure station B. At exposure station B, an original document 30 is positioned facedown upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on the photoconductive surface having a negative polarity which corresponds to the informational areas contained within original document 30. Thereafter, belt 10 advances the electrostatic latent image recorded on photoconductive surface 12 to development station C.

At development station C, the magnetic brush development system of the present invention, indicated generally by the reference numeral 38, transports marking particles of a positive polarity into contact with the latent image recorded on photoconductive surface 12. The force exerted on the marking particles by the electrostatic image attracts the marking particles from developer roller 40 thereto. This forms a powder image on photoconductive surface 12 of belt 10 which corresponds to the informational areas contained within original document 30. The detailed structure of development system 38 will be described hereinafter with reference to FIGS. 2 and 3.

After development, belt 10 advances the powder image to transfer station D. At transfer station D, a sheet of support material 42 is moved into contact with the powder image. By way of example, the sheet of support material may be paper. The copy paper is advanced to transfer station D by a sheet feeding apparatus, indicated generally by the reference numeral 44. Preferably, sheet feeding apparatus 44 includes a feed roller 46 contacting the uppermost sheet of stack 48. Feed roller 46 rotates to advance the sheet from stack 48 onto conveyor 50. Conveyor 50 transports the sheet into chute 52 which guides sheet 42 into contact with photoconductive surface 12 of belt 10 in a timed sequence so that the powder image developed thereon contacts the advancing sheet 42 at transfer station D.

Transfer station D includes a corona generating device 54 which sprays negative ions onto the back side of sheet 42. In this way, sheet 42 is charged to an opposite polarity from the marking particles adhering to photoconductive surface 12 of belt 10. The powder image is attracted from photoconductive surface 12 to sheet 42.

After the marking particles have been transferred to sheet 42, conveyor 56 advances the sheet in the direction of arrow 58 to fusing station E. Fusing station E includes a fuser assembly, indicated generally by the reference numeral 60, which permanently affixes the transferred powder image to copy sheet 42. Preferably, fuser assembly 60 includes a heated fuser roll 62 and back-up roll 64. Sheet 42 passes between fuser roll 62 and back-up roll 64 with the powder image contacting fuser roller 62. In this manner, the powder image is permanently affixed to sheet 42. After fusing, chute 66 guides the advancing sheet to catch tray 68 for subsequent removal from the printing machine by the operator.

Invariably, after the copy sheet is separated from photoconductive surface 12 of belt 10, some residual particles remain adhering thereto. These residual particles are removed from photoconductive surface 21 at cleaning station F. Cleaning station F includes a preclean corona generating device (not shown) and a rotatably mounted fibrous brush 70 in contact with photoconductive surface 12. The preclean corona generating device neutralizes the charge attracting the particles to the photoconductive surface. These particles are then cleaned from the photoconductive surface by the rotation of brush 70 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an illustrative electrophotographic printing machine incorporating the features of the present invention therein.

Figure 2:
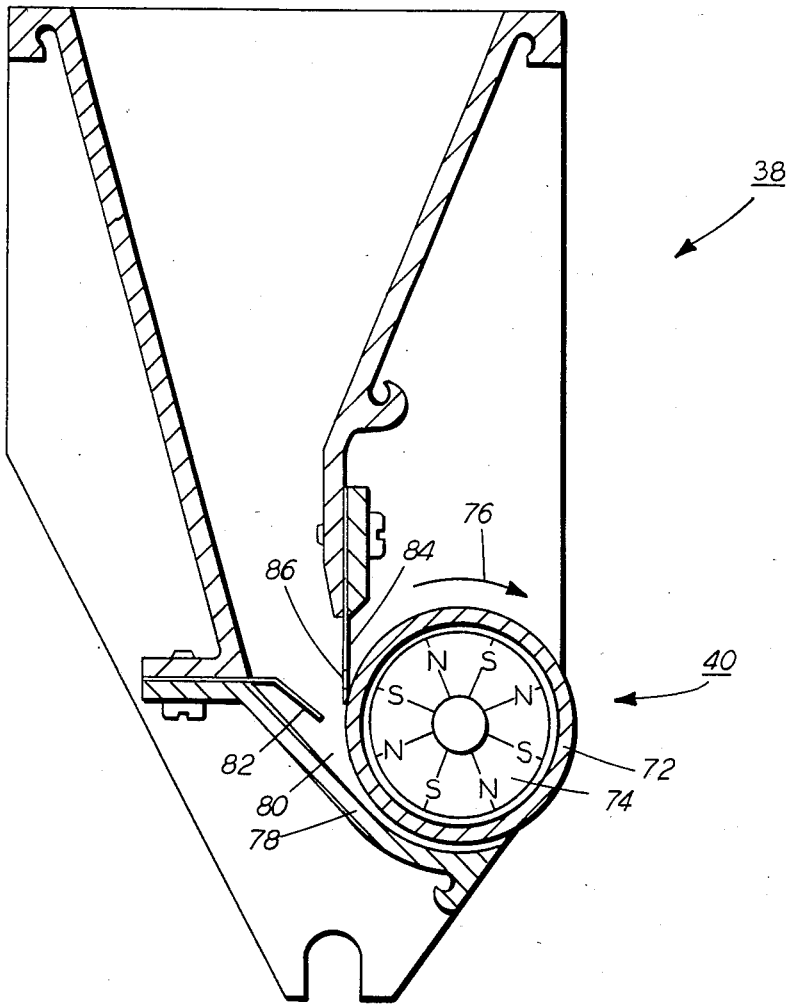
FIG. 2 is an elevational view showing schematically the development apparatus used in the FIG. 1 printing machine.

Referring now to FIG. 2, there is shown the features of the development apparatus of the present invention in greater detail. As depicted thereat, development apparatus 38 includes a developer roller, indicated generally by the reference numeral 40. Developer roller 40 includes a non-magnetic tubular member 72. Preferably, tubular member 72 is made from stainless steel having the exterior circumferential surface thereof roughened. A polymeric layer is coated thereon. The peaks of the roughened surface extend outwardly beyond the polymeric layer. Tubular member 72 is interfit over magnetic member 74. Preferably, magnetic member 74 is made from barium ferrite in the form of a cylindrical member having twelve magnetic poles impressed about the circumferential surface thereof. The maximum radial magnetic field at the surface of magnet 74 is about 650 gauss. Tubular member 72 rotates at a tangential velocity ranging from about 16 centimeters per second to about 58 centimeters per second. Magnetic member 74 rotates at an angular velocity ranging from 1000 rpm to 1500 rpm. In this way, the marking particles move in the direction of arrow 76. Housing 78 stores a supply of marking particles in chamber 80 thereof. Initially, the marking particles advance beneath pre-metering blade 82. The free edge of blade 82 is spaced a distance ranging from 1 to 2 millimeters from the surface of tubular member 72. Preferably, metering blade 82 is made from sheet metal. After the layer of marking particles has passed through the gap between the free end of metering blade 82 and the surface of tubular member 72, blade 84 controls the resultant layer of marking particles advanced into the development zone closely adjacent to the latent image recorded on photoconductive surface 12 of belt 10. The free end portion of blade 84 is resiliently urged into contact with the peaks of the roughened surface of tubular member 72 while being spaced from the polymeric layer coated thereon. Blade 84 has a plurality of substantially equally spaced apertures 86 through which the marking particles pass. The size of apertures 86 controls the thickness of the layer of marking particles being advanced by developer roller 40 into the development zone. Preferably, blade 84 is made from stainless steel about 0.05 millimeters thick. The free end of blade 84 forms a 15° angle with a plane tangential to the surface of tubular member 72 and normal to a radius thereof. A hard, low friction coating may be plated on the tip of blade 84, e.g. chromium, to reduce the friction between blade 84 and developer roller 40. The apertures in blade 84 are preferably of a trapezoidal cross section. However, the aperture cross section is dependent upon the type of marking particles utilized. Trapezoidal apertures are preferably employed with marking particles comprising 40% by weight of magnetite, 59.5% by weight of a polymer resin and charge control agent, and 0.5% by weight of an aluminum oxide flow agent blended into the marking particles after fabrication.

Figure 3:
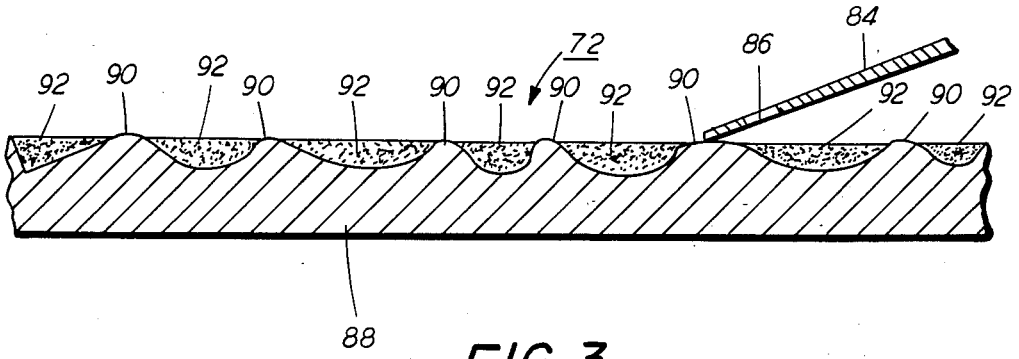
FIG. 3 is a fragmentary, sectional view showing the developer roller used in the FIG. 2 development system.

As shown in FIG. 3, tubular member 72 includes a support member 88 having the exterior circumferential surface thereof roughened to form a multiplicity of peaks 90 extending outwardly therefrom. A polymeric coating 92 fills the spaces between adjacent peaks 90. The uppermost portion of adjacent peaks 90 extends beyond the polymeric coating 92 so that the free end of blade 84 rides on peaks 90. In this way, blade 84 does not wear the surface of polymeric coating 92 down. Support member 88 may have the circumferential surface thereof roughened by any suitable chemical or mechanical means. For example, plasma etching appears to be a satisfactory process. The exposed portion of peaks 90 is a very small fraction of the total circumferential surface of tubular member 72. Preferably, the exposed peaks 90 are about 5% of the total surface area of support member 88. Developer roller 72 is electrically biased to a potential intermediate that of the background potential and latent image recorded on photoconductive surface. By way of example, the electrical bias may range from about 50 volts to about 300 volts. The average spacing between adjacent peaks should be small enough so that the non-uniformity in electrical field lines produced by the roughened surface in the development zone does not produce visible non-uniformities in the resultant copy. Preferably, the spacing between adjacent peaks should be less than the spacial dimensions that the eye can resolve. Hence, the spacing between adjacent peaks should be about 10 microns. Polymeric coating 92 is chosen for its ability to triboelectrically charge the marking particles moving thereover. By way of example, a suitable polymeric coating is made from a polyvinylidine fluoride based material.

In recapitulation, the development apparatus of the present invention includes a developer roller comprising a tubular member having the exterior circumferential surface thereof roughened to form a multiplicity of peaks thereon. A polymeric coating fills the spaces between adjacent peaks with the uppermost portion of the peaks extending beyond the coating. A metering blade having the free end portion thereof in contact with the peaks has a plurality of equally spaced apertures therein through which the marking particles pass prior to advancing to the development zone. The free end of the metering blade is spaced from the polymeric coating minimizing wear thereof. One skilled in the art will appreciate that the polymeric coating may be initially applied over the entire surface of the support member and that as the blade wears the polymeric coating, the peaks of the support member are exposed. Thus, the rapid wear characteristics of the polymeric coating may be utilized advantageously by actually removing the uppermost layers thereof to expose the peaks of the support member. It is thus clear that the developer roller of the present invention provides a solution to two diametrically opposite problems, i.e. the utilization of a hard, rigid metering blade and the necessity to employ a soft polymeric coating on the developer roller.

It is, therefore, evident that there has been provided in accordance with the present invention an apparatus for developing an electrostatic latent image that fully satisfies the aims and advantages hereinbefore set forth. While this invention has been described in conjunction with a preferred embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for developing a latent image recorded on an image receiving member, including:

a housing defining a chamber for storing a supply of marking particles therein;

means for transporting the marking particles from the chamber in said housing to a development zone closely adjacent to the latent image recorded on the image receiving member, said transporting means comprising a support member having the exterior surface thereof roughened forming a multiplicity of peaks extending outwardly therefrom with a coating of a polymeric material filling the space between adjacent peaks so that at least a portion of the peaks of the support member extend beyond the coating of polymeric material thereon; and means for controlling the thickness of the layer of marking particles on said transporting means, said controlling means having a free edge contacting the peaks of the support member of said transporting means and being spaced from the polymeric material coated thereon.

2. An apparatus according to claim 1, wherein said controlling means includes a blade.

3. An apparatus according to claim 2, wherein the support member is made from a material having a hardness greater than the hardness of the polymeric coating thereon.

4. An apparatus according to claim 3, wherein the movement of the marking particles over the polymeric coating induces a triboelectric charge in the marking particles.

5. An apparatus according to claim 4, wherein the peaks of the support member of said transporting means comprise about 5% of the surface area of the support member.

6. An apparatus according to claim 5, wherein the spacing between adjacent peaks of the support member of said transporting means is about 10 microns.

7. An apparatus according to claim 6, wherein the support member of said transporting means includes a tubular member.

8. An apparatus according to claim 7, wherein said transporting means includes an elongated magnetic member disposed interiorly of and spaced from said tubular member.

9. An apparatus according to claim 8, wherein said blade includes a plurality of substantially equally spaced apertures through which the marking particles pass prior to being transported into the development zone.

10. An apparatus according to claim 9, wherein said blade is made from a stainless steel material.

11. An apparatus according to claim 10, wherein said tubular member is made from a metal material.

12. An apparatus according to claim 11, wherein the free edge of said blade has a hard, low friction coating plated thereon.

13. An apparatus according to claim 12, wherein the polymeric coating on said tubular member is made from a polyvinylidene fluoride based material.

14. An electrophotographic printing machine of the type having a photoconductive member arranged to have a latent image recorded thereon, wherein the improvement includes:

a housing defining a chamber for storing a supply of marking particles therein;

means for transporting the marking particles from the chamber in said housing to a development zone closely adjacent to the latent image recorded on the photoconductive member, said transporting means comprising a support member having the exterior surface thereof roughened forming a multiplicity of peaks extending outwardly therefrom with a coating of polymeric material filling the space between adjacent peaks so that at least a portion of the peaks of the support member extend beyond the coating of polymeric material thereon; and means for controlling the thickness of the layer of marking particles on said transporting means, said controlling means having a free edge contacting the peaks of the support member of said transporting means and being spaced from the polymeric material coated thereon.

15. A printing machine according to claim 14, wherein said controlling means includes a blade.

16. A printing machine according to claim 15, wherein the support member is made from a material having a hardness greater than the hardness of the polymeric coating thereon.

17. A printing machine according to claim 16, wherein movement of the marking particles on the polymeric coating induces a triboelectric charge therein.

18. A printing machine according to claim 17, wherein the peaks of the support member of said transporting means comprise about 5% of the surface area of the support member.

19. A printing machine according to claim 18, wherein the spacing between adjacent peaks of the support member of said transporting means is about 10 microns.

20. A printing machine according to claim 19, wherein the support member of said transporting means includes a tubular member.

21. A printing machine according to claim 20, wherein said transporting means includes an elongated magnetic member disposed interiorly of and spaced from said tubular member.

22. A printing machine according to claim 21, wherein said blade includes a plurality of substantially equally spaced apertures through which the marking particles pass prior to being transported into the development zone.

23. A printing machine according to claim 22, wherein said blade is made from a stainless steel material.

24. A printing machine according to claim 23, wherein said tubular member is made from a metal material.

25. A printing machine according to claim 24, wherein the free edge of said blade has a hard, low friction coating plated thereon.

26. A printing machine according to claim 25, wherein the polymeric coating on said tubular member is made from a polyvinylidene fluoride.

* * * * *